US006190292B1

(12) United States Patent
Panes

(10) Patent No.: US 6,190,292 B1
(45) Date of Patent: Feb. 20, 2001

(54) ATHLETIC APPARATUS AND METHOD OF USE

(76) Inventor: Howard Panes, 49 Leonard Ter., Roseland, NJ (US) 07068

( * ) Notice: Under 35 U.S.C. 154(b), the term of this patent shall be extended for 0 days.

(21) Appl. No.: 09/275,720

(22) Filed: Mar. 24, 1999

Related U.S. Application Data

(60) Provisional application No. 60/110,826, filed on Dec. 2, 1998.

(51) Int. Cl.[7] ..... A63B 1/00

(52) U.S. Cl. ..... 482/93; 482/109

(58) Field of Search ..... 482/74, 93, 105–109, 482/111

(56) References Cited

U.S. PATENT DOCUMENTS

| | | | | |
|---|---|---|---|---|
| 259,752 | | 6/1882 | Fisher, Jr. . | |
| 560,517 | | 5/1896 | Metzger . | |
| 1,316,683 | | 9/1919 | Calvert . | |
| 1,536,048 | | 5/1925 | Alastalo . | |
| 2,941,219 | * | 6/1960 | Irving | 482/111 |
| 3,403,906 | | 10/1968 | Burzenski . | |
| 3,468,534 | | 9/1969 | Donato . | |
| 4,610,447 | * | 9/1986 | Byrd | 482/74 |
| 4,634,121 | * | 1/1987 | Sasaki | 482/109 |
| 4,828,256 | | 5/1989 | Lee . | |
| 5,114,371 | * | 5/1992 | Alonzo | 441/129 |
| 5,139,472 | | 8/1992 | Caruthers | 482/93 |
| 5,171,199 | | 12/1992 | Panagos | 482/106 |
| 5,242,348 | | 9/1993 | Bates | 482/105 |
| 5,334,118 | | 8/1994 | Dantolan | 482/93 |
| 5,433,438 | | 7/1995 | Gilman | 273/58 |
| 5,536,227 | | 7/1996 | Polchek et al. | 482/93 |

FOREIGN PATENT DOCUMENTS 2333 1/1905 (GB) .

* cited by examiner

*Primary Examiner*—John Mulcahy
(74) *Attorney, Agent, or Firm*—Eric Karich

(57) ABSTRACT

An athletic apparatus has a resilient ball having a cylinder glued into a conduit positioned across a diameter of the ball. A pair of handles are removably attachable to the ball to facilitate a plurality of exercises and stretching activities. Each handle has a cylindrical base and a padded handle cover. A spring positioned within the cylindrical base biases a locking portion and an unlocking button through a pair of attachment conduits at the end of the cylindrical base, allowing the locking portion to cooperate with a locking slot located near the end of the cylinder to removably locking the cylindrical base within the cylinder. The apparatus, configured as a simple ball with no handles attached, is functional as a medicine ball. With one handle attached, the apparatus functions as a weighted hammer. With two handles attached, the apparatus functions as a weighted exercise bar. In its preferred embodiment, the athletic apparatus further includes a storage container mounted concentrically within the outer skin and fillable with a fluid.

6 Claims, 3 Drawing Sheets

ATHLETIC APPARATUS AND METHOD OF USE

This application for a utility patent follows a previously filed provisional patent having the Ser. No. 60/110,826 and a filing date of Dec. 2, 1998.

BACKGROUND OF THE INVENTION

1. Field of the Invention

This invention relates generally to athletic equipment, and more particularly to a medicine ball having one or two attachable handles, the attachable handles enabling a plurality of additional exercises.

2. Description of Related Art

The prior art contains a variety of exercise devices, including medicine balls, free-weights, and dumb bells. Simple medicine balls are well known in the prior art; however, none of these references disclose the attachment of handles of any sort to these exercise devices. Gilman, U.S. Pat. No. 5,433,438, for example, discloses a medicine ball having a rigid core surrounded by an outer layer of foamed polyurethane. Gilman does not disclose the attachment of handles to the ball, nor does it teach that this would be a desirable feature.

Calvert, U.S. Pat. No. 1,316,683, Metzger, U.S. Pat. No. 560,517, and Schmidt, U.K. No. 2,333, disclose various embodiments of the traditional dumb bell. These references disclose two handle attachment ports. However, the dumb bells are constructed of steel rather than a resilient material. Furthermore, the handle connections are of entirely different construction. The first handle attachment port is designed to interconnect two dumb bells to form a traditional dumb bell. The second handle attachment port is designed only to facilitate transportation of the dumb bell. The references do not disclose a dumb bell with a resilient construction, nor do they disclose the attachment of two handles to one bell for performing exercises.

An exercise bar having a weight mounted in the middle of the bar is taught by Polchek, U.S. Pat. No. 5,536,227, Lee, U.S. Pat. No. 4,828,256, and Burzenski, U.S. Pat. No. 3,403,906. The references do not disclose the use of a resilient ball as the central weight, nor do they teach the desirability of attaching such a ball. Furthermore, none of these references disclose an attachment means that would allow the device to be used with only one handle, or with no handles at all.

Another example of a novel piece of exercise equipment is disclosed in Fisher, U.S. Pat. No. 259,752, which discloses an exercise club that enables a variety of novel exercises. This reference discloses the attachment of handles to a centrally located weight device; however, it does not disclose the use of a resilient ball as the central weight, nor does it teach the desirability of making this novel combination.

Various additional exercise devices are shown in the prior art. Alastalo, U.S. Pat. No. 1,536,048, discloses a rigid hand bar for physical training. The hand bar is modular, thereby allowing the user to modify the bar to his or her particular exercise. Panagos, U.S. Pat. No. 5,171,199, discloses interlocking dumb bells. Various additional patents have been granted for more unusual exercise devices. Donato, U.S. Pat. No. 3,468,534, for example, discloses an exercise bar with revolvable arms; and Dantolan, U.S. Pat. No. 5,334,118, discloses a reciprocating weight exercise device.

The prior art teaches medicine balls; and the prior art teaches exercise bars with the weights mounted on the middle of the bar; and the prior art also teaches an exercise club. However, the prior art does not teach a single device that can be adapted to fulfill the goals of all of these weights in one piece of exercise equipment. The present invention fulfills these needs and provides further related advantages as described in the following summary.

SUMMARY OF THE INVENTION

The present invention teaches certain benefits in construction and use which give rise to the objectives described below.

The present invention provides an athletic apparatus having a weighted, resilient ball having a means for receiving a pair of handles, allowing the handles to be removably attached to the ball with a handle attachment means working in conjunction with a handle engagement means. The apparatus, configured as a simple ball with no handles attached, is functional as a medicine ball. With one handle attached, the apparatus allows various functional exercises such as rowing, shoveling, and hammering. With two handles attached, the apparatus functions as a range limiter for push-ups, and it allows various kneeling and stretching exercises to strengthen and stretch the shoulders and upper back. Since the apparatus can adapt to three different configurations, this one product enables a large number of different exercises and stretching activities. In its preferred embodiment, the athletic apparatus further includes a storage container mounted concentrically within the outer skin and providing a means for selectively filling the storage container with a fluid to change the weight of the apparatus.

A primary objective of the present invention is to provide an athletic apparatus having advantages not taught by the prior art.

Another objective is to provide an athletic apparatus that enables a great number of exercises through its capability to quickly and easily add or remove one or two handles.

A further objective is to provide an athletic apparatus that can be easily adapted to provide a range of weights for varying degrees of resistance while performing the various exercises and stretching activities.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
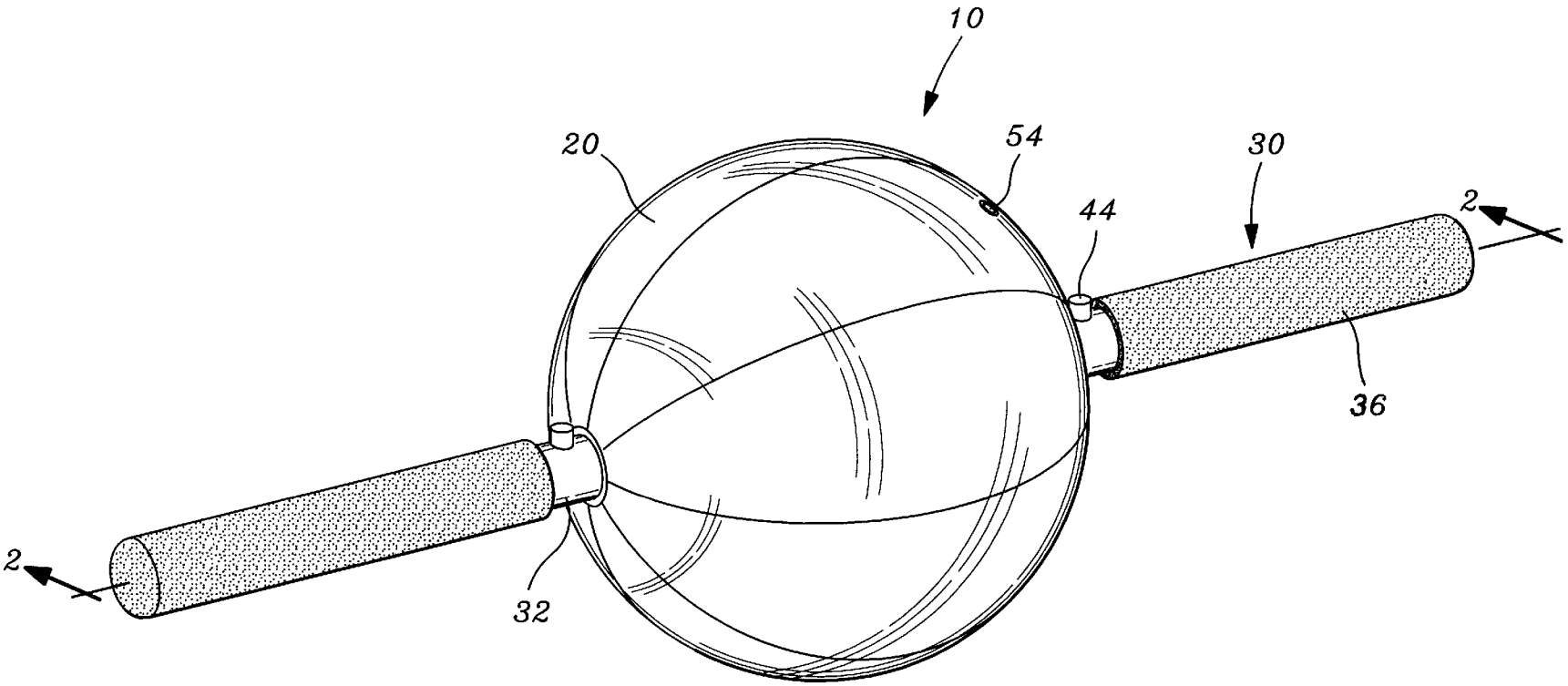
FIG. 1 is a perspective view of the preferred embodiment of the present invention.

The above described drawing figures illustrate the invention, an athletic apparatus 10 having a weighted ball 20 and a pair of removable handles 30. Since the apparatus 10 can adapt to three different configurations, this one product enables an large number of different exercises and stretching activities. The apparatus 10, configured as a simple ball 20 with no handles 30 attached, is functional as a medicine ball. With one handle 30 attached, the apparatus 10 allows various functional exercises such as rowing, shoveling, and hammering. Fully assembled with two handles 30, as shown in FIG. 1, the apparatus 10 enables a plurality of exercise and stretching exercises. The apparatus 10 allows all of the exercises performed with traditional exercise bars, and also functions as a range limiter for push-ups, and it allows various kneeling exercises to stretch and strengthen the shoulders, upper back, and chest.

In addition to enabling traditional exercises, the apparatus 10 also enables a large number of unique exercises. Since the user can hold the apparatus 10 by either the ball 20 or the handles 30, the apparatus 10 is well suited for various tossing and throwing exercises that improve strength, reaction time, and hand-eye coordination. The tossing exercises can be performed alone or between different users. Individuals can practice martial arts moves with the device, and groups can practice martial arts kicks using the ball 20 as the target. By manipulating the ball 20 or one of the handles 30, a personal trainer can guide the physical training with ease, as well as apply manual resistance to increase the difficulty of the exercises being performed. These sample exercises, some of which are described more fully below, are included for illustration only. This apparatus 10 enables hundreds of different exercises and stretching activities, and the scope of this invention should not be limited to the specific examples provided.

As shown in FIG. 1, the ball 20 has a resilient outer skin 21 adapted for conforming to a desired shape. While it is referred to as a ball 20, it is possible to conform the outer skin 21 to a plurality of shapes having a plurality of sizes, depending on the needs of the user. In its preferred embodiment, the ball 20 is a molded rubber sphere. The molded rubber sphere provides a surface that is more comfortable to work with than the hard metal used by many exercise devices. Furthermore, the softer surface of the molded rubber sphere allows the ball 20 to be used in stretching activities wherein the ball 20 contacts the user's body. The thickness of the molded rubber sphere is modified to control the weight of the ball 20. In lighter embodiments, the molded rubber sphere has a thin skin; and in heavier embodiments, the molded rubber sphere has a thicker skin, or even has a solid rubber core. The weight of the molded rubber sphere can also be modified by changing the overall diameter of the ball 20; and the weight can be modified by inserting metal components into the interior of the molded rubber sphere. Such modifications are well known and readily understood by those skilled in the art, and so therefore are not discussed at length. In the preferred embodiment, the ball 20 has a diameter of approximately 9 inches. Alternative embodiments include a leather skin over a variety of natural or synthetic materials that are both weighted and preferably not overly hard or rigid. Another alternative embodiment is disclosed in Gilman, U.S. Pat. No. 5,433,438, hereby incorporated by reference in full.

Figure 2:
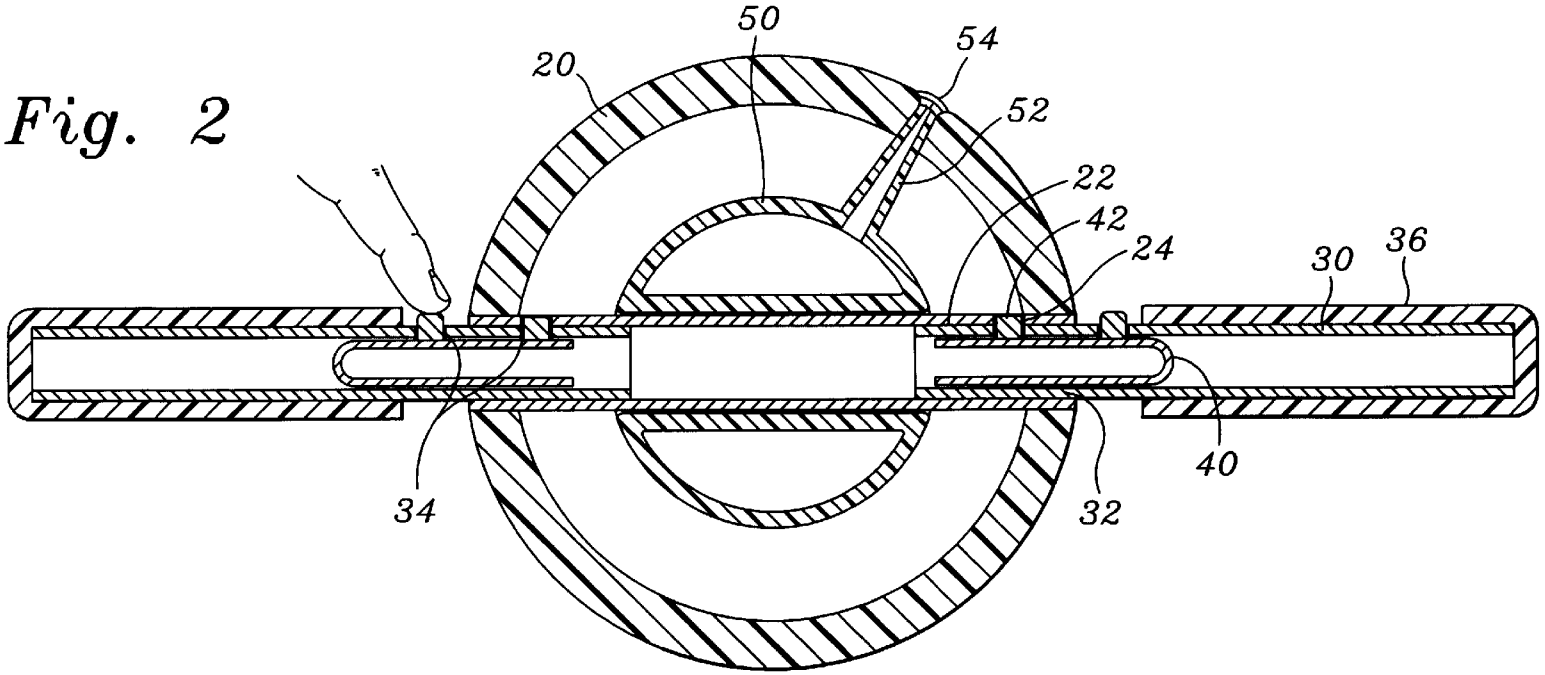
FIG. 2 is a sectional view thereof taken along line 2—2 in FIG. 1.

As shown in FIG. 2, the ball 20 includes a means for receiving handles 22, hereinafter referred to as the handle receiving means. The handle receiving means 22 is fixedly and immobily engaged within the ball 20; and the handle receiving means 22 preferably extends across a diameter of the ball 20. The handle receiving means 22 is preferably a cylinder extending through a diameter of the ball 20. The ball 20 is preferably molded around the cylinder 22 to secure the cylinder 22 in place. The cylinder 22 must be strong and durable enough to hold the handles 30 in place during use, and it is preferably made of a rigid material such as metal or hard plastic. The cylinder 22 includes at least one means for handle engagement 24, hereinafter referred to as the handle engagement means. The cylinder 22 preferably includes a pair of diametrically opposed handle engagement means. The handle engagement means 24 allows either one or two handles 30, described below, to be attached to the ball 20. The handle engagement means 24 is discussed more fully in the following section.

Figure 3:
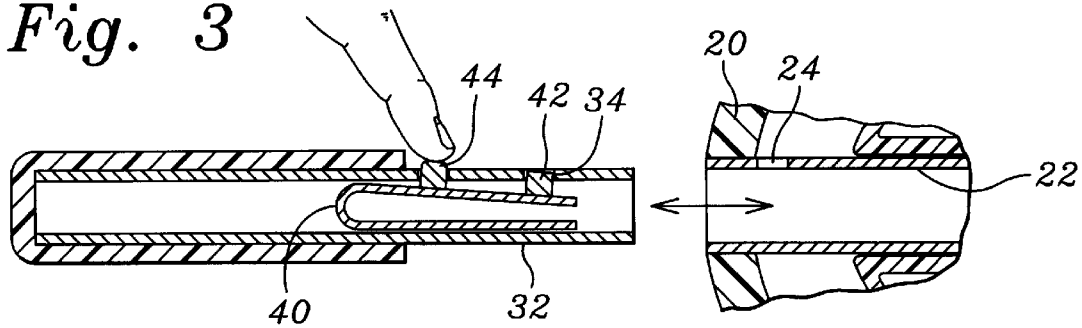
FIG. 3 is a partial sectional view thereof, showing how a handle fits into the ball.

The apparatus 10 includes at least one handle 30, although the apparatus 10 potentially includes a plurality of handles 30, depending on the exercises that the user wishes to accomplish. In its preferred embodiment, as shown in FIG. 2, the apparatus 10 includes a pair of diametrically opposed handles 30. Each of the handles 30 is preferably a steel cylinder having a cylindrical base 32 and a padded handle cover 36. The cylindrical base 32 includes a means for attaching the handle 40 to one of the handle engagement means 24 of the cylinder 22. The means for attaching the handle 40 is hereinafter referred to as the handle attachment means. The handle attachment means 40 of each handle 30 preferably removably engages the opposing ends of the cylinder 22 at a handle engagement means 24. As shown in FIGS. 2 and 3, the handle attachment means 40 is preferably a spring positioned within the cylindrical base 32 of the handle 30. The spring 40 includes a locking portion 42 and an unlocking button 44. The spring 40 biases the locking portion 42 and the unlocking button 44 through a pair of attachment conduits 34 at the end of the cylindrical base 32. The locking portion 42 cooperates with the handle engagement means 24, preferably a locking slot located near the end of the cylinder 22, thereby removably locking the cylindrical base 32 within the cylinder 22. As shown in FIG. 2, when the locking portion 42 is properly engaged within the locking slot 24, the unlocking button 44 is positioned outside the cylinder 22. As shown in FIG. 3, the user can retract the locking portion 42 from the locking slot 24 by depressing the unlocking button 44, thereby overcoming the bias of the spring 40 and causing the locking portion 42 to be retracted into the cylindrical base 32. Other handle attachment means 40 and handle engagement means 24 can be devised by those skilled in the art. In one alternative embodiment, the handle threadedly engages the cylinder 22. In another alternative embodiment, the handle frictionally fits inside the cylinder 22. The prior art is filled with various locking mechanisms that may be adapted to this invention, and those skilled in the art can devise many other embodiments that should be considered equivalent to this invention.

The apparatus 10 preferably includes a storage container 50 mounted concentrically within the outer skin 21 and providing a means for selectively filling 52 the storage container 50 with a fluid. In its preferred embodiment, the storage container 50 is a rubber bladder having a fluid conduit 52 for adding and removing fluid. The fluid conduit 52 is preferably sealed with a cap 54 to prevent fluid from escaping the storage container during a workout. This rubber bladder 50 is especially useful for increasing the mobility of the apparatus 10. The lightweight ball 20 is easily transported, then filled with water before the apparatus 10 is used for a workout. It is understood that there are many additional methods known in the art to supplement this change in weight, including but not limited to the addition and subtraction of metal weights to the interior of the ball 20.

Figure 5:
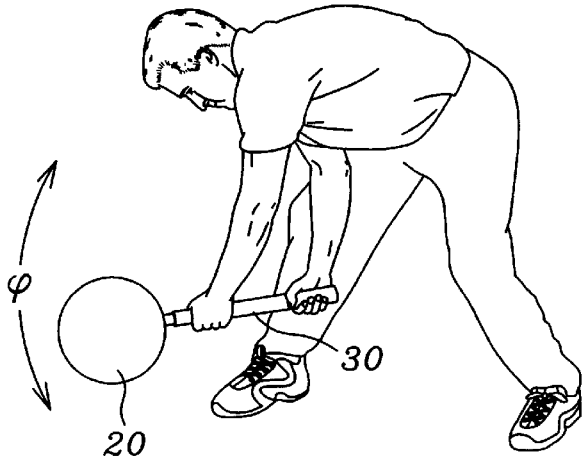
FIG. 5 is a perspective view of the invention being used in a second exercise.

In use, the user starts with the ball 20 alone. This ball 20 is useful as a medicine ball. It can be thrown, tossed from hand to hand for coordination exercises, and otherwise used as a weight training device. Since the ball 20 is relatively soft and resilient, it can be used in direct contact with the user's body, as a motion limitation device and as a stretching tool. Those skilled in the art are familiar with how to use a medicine ball of this type. The user can then attach one handle 30 to the ball 20. To accomplish this connection, as shown in FIG. 3, the user depresses the unlocking button 44 and slides the cylindrical base 32 of the handle 30 into the cylinder 22. The user then releases the unlocking button 44, allowing the spring 40 to bias the locking portion 42 into the locking slot 24 of the cylinder 22. Once the handle 30 has been attached, as shown in FIG. 5, the user can perform the various exercises described above.

Figure 4:
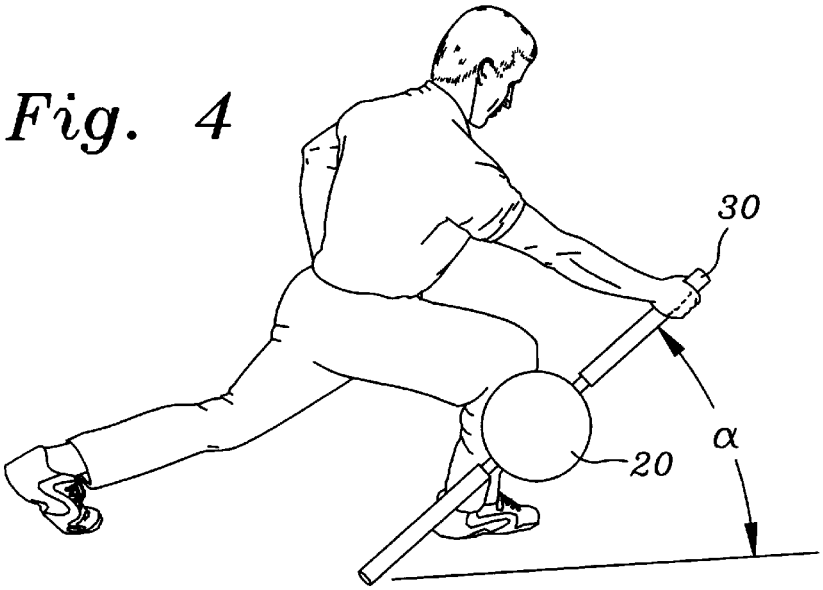
FIG. 4 is a perspective view of the invention being used in a first exercise.
Figure 6:
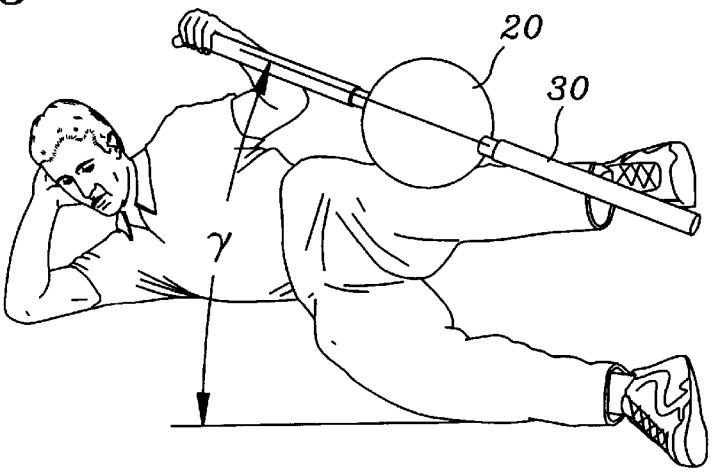
FIG. 6 is a perspective view of the invention being used in a third exercise.

The user can proceed to attach a second handle 30 to the ball 20. By repeating the steps described above, a second handle 30 can be attached to the ball 20, preferably directly opposite the first handle 30. As shown in FIGS. 4 and 6 and as described above, this two-handled apparatus 10 is useful for a plurality of additional exercises. An exercise bar having the weighted mass mounted on the middle of the bar provides advantages over traditional exercise bars having the mass mounted on the ends of the exercise bar. These advantages are discussed in Lee, U.S. Pat. No. 4,828,256, hereby incorporated by reference in full. By providing a round mass on the center of the exercise bar, you enable further training, exercising, and stretching activities because a round apparatus 10 can easily roll while in use. This is discussed in more detail in Burzenski, U.S. Pat. No. 3,403, 906, hereby incorporated by reference in full.

Finally, the user can adjust the weight of the apparatus 10 at will. First, the user removes the cap 54 from the rubber bladder 54 described above. Second, the user adds water or other fluid through the fluid conduit 52 into the rubber bladder 50 until the rubber bladder 50 is full or until the desired weight is attained. Third, the user replaces the cap 54, thereby sealing the water inside the rubber bladder 50. The additional mass of the water adds the desired resistance to the workout. This water can then be removed once the workout is complete, facilitating storage and transport of the apparatus 10. Furthermore, the handles 30 can also be removed at will, further facilitating storage and transport of the apparatus 10.

In addition to traditional exercises enabled by medicine balls, weighted hammers, and prior art exercise bars, various additional exercises are enabled by this athletic apparatus 10. One example, shown in FIG. 6, is performed when a user grasps one of the handles 30 with a hand while lying on one side, and resting the other handle 30 of the apparatus 10 on his or her ankle. The user proceeds to raise and lower the athletic apparatus 10 by lifting both the arm and the leg. Direct contact between the athletic apparatus 10 and the user is not a problem because of the relatively soft and resilient nature of the ball 20. This exercise cannot be performed using a traditional medicine ball, however, because a medicine ball does not usually provide handles. Another example of an exercise that can be performed, as shown in FIG. 4, includes the user grasping one of the handles 30 with an outstretched hand while resting the other handle 30 on the ground. By stepping forward and back, the user is able to pivot the athletic apparatus 10 up and down. This not only exercises the muscles, it also assists in safely and efficiently stretching back, arm and leg muscles. An additional exercise includes push ups using the athletic apparatus 10, the ball 20 acting as a range limiter.

An additional exercise is the Reaction Squat. The purpose of the Reaction Squat is to incorporate lower body strength training with hand eye coordination. This exercise works the following muscle groups: Quadriceps, hamstrings, gluteus, erector spanea, and abdominal. The exercise is performed in three steps, set up, descent, and ascent. Set up includes the following steps: (1) position feet hip width apart with the feet slightly eternally rotated; (2) extend knees to 180 degrees; (3) extend hips fully and position them parallel to the front wall; (4) straighten torso with a slight arch in the lower back (lordotic curve); (5) position the head in a neutral position with eyes looking forward; and (6) hold ball with two hands with the weight at the top of the bar. Descent includes the following steps: (1) release the ball; (2) flex knees to approximately 90 degrees; (3) flex the hips to approximately 120 degrees; (4) slight flexion of the spine 140 degrees; (5) do not round the upper back, lower back should remain in a lordotic curved position; and (6) at the lowest point of the squat the ball is caught with two hands. Ascent includes the following steps: (1) extend knees back to starting position; (2) extend hips back to starting position; (3) extend spine back to starting position; and (4) when finished the body should return to the same starting position.

Another exercise is the Shovel. The purpose of the Shovel is to simulate the outdoor movement of shoveling snow. The muscle groups trained include the following: Quadriceps, hamstrings, gluteus, erector spanea, latitimus dorsi, abdominal, and Biceps. This exercise also includes a set up, a descent, and an ascent. The set up includes the following steps: (1) position feet shoulder width apart; (2) position body perpendicular to the front wall; (3) hold ball with an underhand grip apart shoulder width apart; (4) position head straight ahead, shoulders square, lower back slightly arched, arms and legs slightly flexed. Descent includes the following steps: (1) flex knees to 120 degrees and flex hips to 160 degrees while keeping feet flat and slightly eternally rotated; (2) flex spine slightly to approximately 160 degrees; (3) at the lowest part of descent, flex triceps and extend arm outward; (4) flex trunk laterally and dip the lead shoulder; and (5) the lower back should be stable and slightly arched, without rounding the upper back for compensation. The ascent includes the following stps: (1) extend knees back to 180 degrees and extend hips to starting position 180 degrees; (2) extend lower back to neutral position (slightly arched); (3) once knees and hips are fully extended flex arms and extend outward; and (4) abdominals should be contracted in a smooth and circular motion through the entire range of motion.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An athletic apparatus comprising:

a resilient ball having a resilient outer skin adapted for conforming to a desired shape and an inner skin defining a storage container mounted concentrically within the outer skin;

means for selectively filling and sealing water within the storage container;

and, fixedly and immobily engaged within the ball and extending at least partially across a diameter thereof, a means for receiving at least one handle;

the means for receiving at least one handle having at least one means for engaging the handle;

at least one handle formed by a cylinder, the at least one handle having a means for attaching the at least one handle to the at least one handle engagement means, wherein the at least one handle may be removably joined to the ball.

2. An athletic apparatus comprising:

a ball having a resilient outer skin adapted for conforming to a desired shape and an inner skin defining a storage container mounted concentrically within the outer skin;

means for selectively filling and sealing water within the storage container;

and, fixedly and immobily engaged within the ball and extending across a diameter thereof, a means for receiving handles;

a pair of handles, each of the pair of handles providing a means for attaching the handle to one of a pair of diametrically opposed means for handle engagement of the handles receiving means, each of the pair of handles being formed by a cylinder;

wherein the pair of handles may be removably engaged at opposing ends of the handles receiving means.

3. A method for exercising with an athletic apparatus, the method comprising the steps of:

a) providing a ball having a resilient outer skin and an inner skin defining a storage container mounted concentrically within the outer skin and means for selectively filling and sealing water within the storage container;

b) fixedly and immobily engaging within the ball a means for receiving a pair of handles such that the handle receiving means extends across a diameter of the ball, the handle receiving means having a pair of handle engagement means;

c) providing a pair of handles, each handle having a means for attaching the handle to one of the handle engagement means of the handle receiving means; and d) removably joining each of the pair of handles to one of the handle engagement means.

4. The method of claim 3 further comprising the step of:

e) grasping one of the handles with a hand while lying on one side, and resting the other handle on an ankle; and f) raising and lowering the athletic apparatus by lifting both the arm and the leg.

5. The method of claim 3 further comprising the step of:

e) grasping one of the handles with an outstretched hand while resting the other handle on the ground; and f) pivoting the athletic apparatus up and down by stepping forward and back.

6. An athletic apparatus comprising:

a ball having a resilient outer and an inner skin defining a storage container mounted concentrically within the outer skin;

means for selectively filling and sealing water within the storage container;

and, fixedly and immobily engaged within the ball and extending across a diameter thereof, a cylinger having a pair of locking slots located near opposing ends of the cylinder;

a pair of handles, each of the handles having a cylindrical base shaped to removably engage the cylinder, each of the pair of handles having a spring having a locking portion and an unlocking button, the spring biasing the locking portion and unlocking button through a pair of attached conduits at the end of the cylindrical base, the locking portion cooperating with the locking slot to removably lock the cylindrical base within the cylinder such that each of the pair of handles may be removably engaged at opposing ends of the ball.

* * * * *